United States Patent [19]

Hard

[11] 4,298,437

[45] Nov. 3, 1981

[54] METHOD FOR PRODUCING MAGNESIUM METAL FROM MOLTEN SALT

[75] Inventor: Robert A. Hard, Laguna Beach, Calif.

[73] Assignee: Occidental Research Corporation, Irvine, Calif.

[21] Appl. No.: 115,597

[22] Filed: Jan. 25, 1980

[51] Int. Cl.[3] ..... C25C 3/04

[52] U.S. Cl. ..... 204/70

[58] Field of Search ..... 204/70

[56] References Cited

U.S. PATENT DOCUMENTS 3,503,857 3/1970 Hard et al. ..... 204/70

FOREIGN PATENT DOCUMENTS 21976 of 1896 United Kingdom ..... 204/70

*Primary Examiner*—Howard S. Williams

[57] ABSTRACT

The instant invention relates to a method for making magnesium metal by reducing a magnesium metal precursor in an electrochemical cell wherein the cathode is a molten silicon alloy. Magnesium metal is formed at the interface of the silicon alloy and the magnesium metal precursor (or the molten salt if the magnesium metal precursor is suspended as finely divided particles in a molten salt) and subsequently combines with said silicon alloy. The silicon alloy containing combined magnesium metal is removed from said cell to a magnesium metal removal zone wherein an inert gas is passed through the alloy at a temperature and pressure sufficient to remove the magnesium metal as a vapor overhead. The magnesium metal is recovered and the silicon alloy, depleted in magnesium, is returned to the cell for further use as a cathode.

18 Claims, 1 Drawing Figure

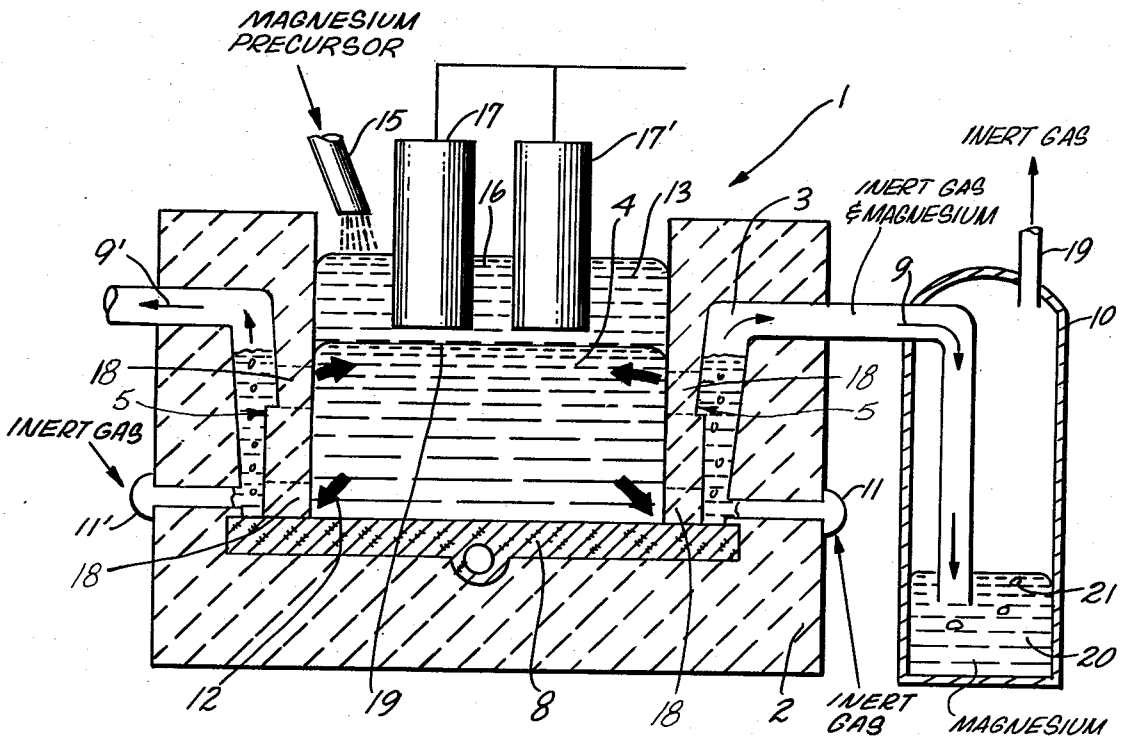
INERT GAS
INERT GAS & MAGNESIUM
MAGNESIUM
INERT GAS
MAGNESIUM PRECURSOR
INERT GAS
1
2
3
4
5
8
9
9'
10
11
11'
12
13
15
16
17
17'
18
19
20
21

METHOD FOR PRODUCING MAGNESIUM METAL FROM MOLTEN SALT

Description of the Prior Art

It is known that magnesium oxide can be reduced to magnesium metal in an electrochemical cell wherein a molten salt in which said magnesium oxide is suspended is floated on a molten ferrosilicon alloy. In this process the molten ferrosilicon alloy is electrically energized to form a cathode, and the magnesium oxide is converted to magnesium metal at the interface of molten salt and the molten ferrosilicon alloy. This process is described in U.S. Pat. No. 3,503,857; however, the purpose of carrying out such process is to prepare a magnesium ferrosilicon alloy, therefore the recovery of magnesium metal from the molten ferrosilicon alloy is not discussed. If it was desired to recover the magnesium metal, one skilled in the art, might consider carrying out the process described in such patent as a batch process, wherein the magnesium metal is allowed to build up in the molten ferrosilicon alloy until a certain concentration is reached and then the process would be interrupted so that magnesium could be recovered in a separate step. However in a batch operation the magnesium metal would build up at the interface of the molten salt and the molten ferrosilicon and may diffuse back into the molten salt when higher concentrations are achieved. Magnesium metal, which diffuses back into the molten salt, can react with carbon oxides formed at the graphite anode. This reaction would result in the oxidation of magnesium metal back to magnesium oxide. The instant invention overcomes this inefficiency by continuously removing a molten silicon alloy containing magnesium metal to a magnesium metal removal zone wherein an inert gas is passed therethrough to yield magnesium metal vapor overhead. The metal alloy depleted in magnesium is recycled back to the electrochemical cell for further use as a cathode. Thus the magnesium metal concentration at the interface will be maintained at a low level and the efficiency of the reduction of the magnesium metal precursor to magnesium metal will be increased.

U.S. Pat. No. 993,391 teaches a method for recovering a metal by passing an inert gas through a molten mixture containing said metal. In this process sodium metal is recovered from its alloy with another metal, e.g. lead.

This reference does not teach a process for recovery of magnesium metal nor, as disclosed in the preferred embodiment of the instant invention, is the sodium metal precursor dispersed in a molten salt for the purpose of reduction to the metal.

The use of inert gases in electrochemical production of metal from molten salt is well known. For example, U.S. Pat. Nos. 2,879,213 and 3,728,234 disclose processes which utilize an inert gas to protect a reactive metal which is prepared from a molten salt precursor. In both of these processes however, the purpose of inert gas is not to separate the metal as a vapor from its alloy, but to protect the metal from reactants.

U.S. Pat. No. 1,584,689 teaches a process for separating magnesium metal by vacuum distillation. This process does not teach the use of an inert gas to separate magnesium metal from its alloy. In this process the magnesium salt is prepared by electrically reducing a molten bath containing mixed fluorides including magnesium fluoride and magnesium oxide. There is no suggestion of the use of a molten silicon alloy cathode for reducing the magnesium salts to the metal.

BRIEF SUMMARY OF THE INVENTION

The instant invention relates to a method for producing magnesium metal which comprises the steps of;

(a) providing a molten magnesium metal precursor, (b) providing molten silicon alloy beneath the molten magnesium metal precursor in contact therewith, the density of the molten magnesium metal precursor being less than that of the molten alloy, (c) applying an electric potential to the molten silicon alloy whereby it is cathodically energized, (d) contacting the molten magnesium metal precursor with an anodically energized electrode, (e) causing an electric current to flow between the anodically energized electrode and the cathodically energized molten silicon alloy sufficient to reduce said magnesium metal precursor whereby magnesium metal is liberated and deposited on the molten silicon alloy and dissolved therein, and (f) passing an inert gas through said molten silicon alloy containing magnesium metal dissolved therein at conditions whereby a substantially pure magnesium metal vapor is removed from said molten silicon alloy.

For energy efficiency, the magnesium metal precursor is suspended as finely divided particles in a molten salt which provides a flux to convert the precursor to a liquid at a temperature below the melting point of such precursor. For example, magnesium oxide, the most preferred magnesium metal precursor for use in the process of this invention, which melts at 2852° C., may be solubilized in a mixture of two or more alkaline or alkaline earth metal fluorides at a temperature of from 1250° to 1350° C. or lower.

BRIEF DESCRIPTION OF THE FIGURE

The FIGURE describes an electrochemical cell suitable for carrying out the method of the instant invention.

DETAILED DESCRIPTION

The instant invention relates to a method for producing magnesium metal which comprises the steps of:

(a) providing a molten salt bath suitable for use as an electrolyte in the electrolysis of a magnesium metal precursor.

(b) providing molten ferrosilicon beneath the molten salt bath and in contact therewith, the density of the molten salt bath being less than that of the molten ferrosilicon, (c) applying an electric potential to the molten ferrosilicon whereby it is cathodically energized, (d) contacting the molten salt bath with an anodically energized electrode, (e) suspending the magnesium metal precursor in the molten salt bath, (f) causing an electric current to flow between the anodically energized electrode and the cathodically energized molten ferrosilicon sufficient to reduce said magnesium metal precursor whereby magnesium metal is liberated and deposited on the molten ferrosilicon and dissolved therein, (g) continuously passing a portion of said molten ferrosilicon containing magnesium metal dissolved therein into a magnesium metal removal zone, (h) passing an inert gas through said portion of step (g) at conditions whereby a substantially pure magnesium metal vapor is removed overhead and a molten ferrosilicon fraction depleted in magnesium remains behind, and (i) returning said ferrosilicon fraction depleted in magnesium to said molten ferrosilicon of step (b).

Preferably the magnesium metal precursor is dissolved, solubility 2.5% at least, dispersed as finely divided particles in a molten salt bath which is suitable for use as an electrolyte in the electrolysis of the magnesium metal precursor to the metal. The process can be more readily understood by reference to the figure which shows a cross section of a rectangular (1) electrolytic cell having refactory shell (2) which is divided into compartments (3) and (4) by a graphite rectangular partition (5). Supporting and isolating said partition from the alumina shell is a graphite layer (8) which (as will be explained later) provides an electrical contact to a molten silicon alloy supported thereon.

Exit ports 9 and 9' are in fluid communication with chamber 3 and magnesium recovery chamber 10 which will be described further below. Additional fluid conduits 11 and 11' are in fluid communication with chamber 3 at a point below the interface of the molten silicon alloy and the magnesium metal precursor as will be described further below. Conduits 11 are utilized to pass an inert gas from a source not shown through chamber 3.

A molten silicon alloy which is further described below is placed in chamber 4 which may be described as an electrowinning chamber. This molten alloy is designated by 12 herein.

Floating on said molten silicon alloy is a molten salt mixture (13) which is further described hereinbelow but functions as a flux for the preferred magnesium metal precursor, that is magnesium oxide and magnesium salts which convert to the oxide at the electrowinning temperature described below. A source for providing magnesium oxide or other magnesium metal precursor (16) in a finely divided form is also provided (15). A graphite anode(s) (17 and 17') are in electrical contact with said molten salt (13).

Finally, one or a plurality of ports (18) are provided in the lower portion of partition (5) to provide fluid communication between lower portion of chamber 4 and chamber 3. As shown, these ports allow the molten silicon alloy to pass from chamber (4) to (3) but do not provide fluid access for the molten salt (13).

The method of the instant invention is carried out by electrically energizing anodes (17 and 17') and the silicon alloy (12) through graphite plate (8) to form an electrochemical cell. At the anode, carbon from the electrode will combine with the oxide of magnesium oxide to form carbon oxides. The molten silicon alloy is cathodically energized and therefore, at the interface (19) of the molten silicon alloy and the molten salt, magnesium oxide is reduced to the metal.

Because of the affinity of the silicon for the molten alloy, the magnesium passes into the molten silicon alloy to form a magnesium silicon alloy. This alloy is continuously passed through ports 18 into chamber 3. The cell is maintained at a temperature sufficient to keep all of the ingredients in their molten state. An inert gas is passed through the alloy containing dissolved magnesium metal at a temperature and rate sufficient to carry the magnesium metal as a vapor overhead. The inert gas and the magnesium metal vapor pass through ports 9 and 9' into the magnesium recovery chamber 10 which may include means for maintaining an inert environment (not shown) to protect the reactive magnesium metal and means for returning the inert gas to chamber 3. Although not shown, such means may comprise providing fluid communication between magnesium recovery chamber outlet 19 and conduits 11 and 11' whereby the inert gas may cycle between chamber 3 and magnesium recovery chamber 10. As shown the recovered magnesium metal in chamber 10 is designated as 20, while 21 represents inert gas bubbles which will disengage therefrom and be recycled back to chamber 3. In general, the electrolytic reduction of the magnesium metal precursor to magnesium may be carried out at conditions similar to those disclosed in U.S. Pat. No. 3,503,857. For example, dependent on which silicon alloy is being utilized, the cell operating temperature may be in the temperature range of from about 1250° C. to about 1350° C. However, if the silicon alloy is molten at a lower temperature, lower temperatures may be utilized. For example, the copper silicon alloys disclosed further below are molten at temperatures as low as about 920° C. and therefore the operating range may be extended at least to that lower level when such silicon alloys are being utilized. In general, an upper temperature limit of about 1400° C. is required since despite the nature of the molten silicon alloy the magnesium metal begins to vaporize at this upper limit.

The current density of the cell must be controlled in order to efficiently run the instant method. For example, anode current densities should be less than about 10 amperes per square inch in order to avoid polarization of the anode. Higher current densities may be used but cell efficiency will decrease considerably.

The concentration of magnesium metal in the molten silicon alloy will not exceed about 75% by weight since magnesium is continuously removed by the inert gas passing through compartment 5. In general, the amount of magnesium which builds up in the molten silicon alloy is controlled by the temperature and the rate at which the inert gas is passed through compartment 5 to remove the magnesium metal vapor overhead. For example, at higher temperature and greater rates of inert gas, the magnesium metal may be held to an amount of less than about 5 % by weight in the molten silicon alloy. However, the temperature and the rate of inert gas is generally controlled so that up to about 10% by weight magnesium is included in the molten silicon alloy. One skilled in the art will balance the economics of rapid removal and low magnesium content. Lower magnesium metal content in the molten silicon alloy acts to promote increased rate of reduction of magnesium metal precursor at the interface of the magnesium metal precursor (molten salt) and the molten silicon alloy.

However, the cost of generating and recovering the inert gas may make higher magnesium metal buildup in the molten silicon alloy desirable. In a typical example the rate of passage of inert gas through compartment 5 may be at a ratio of from 1 to 10 lbs. of inert gas per lb. of magnesium removed at the above temperature of cell operation.

In the magnesium removal zone the temperature of the inert gas-magnesium metal vapor mixture is lowered to condense the magnesium metal vapor. For example, the temperature may be lowered to about 900° C. at atmospheric pressure or less to convert substantially all magnesium metal vapor in the inert gas stream to the liquid. The inert gas is substantially insoluble in liquid magnesium metal and passes through the magnesium metal removal zone for recycling to compartment 5.

The inert gas may be selected from the group consisting of argon, neon, krypton, nitrogen, etc. That is, any gas which does not convert the magnesium vapor to a derivative of magnesium is suitable. Argon is preferred because of the economics and its extremely inert nature.

The magnesium metal precursor may be reduced directly in the cell or can be dispersed as finally divided particles in a molten salt mixture. Depending on the melting point of the precursor, one or the other method may be utilized. For example, certain magnesium metal precursors such as magnesium chloride etc. melt at temperatures of as low as 714° C. Therefore, these materials may be used directly with provisions being made to remove any harmful by-products such as hydrochloric acid gas which is a by-product of the reduction of magnesium chloride to the metal. On the other hand, magnesium oxides and magnesium metal precursors which convert to the oxide at the temperature of electrolytical reduction are not molten at such temperatures. These materials thus are conveniently utilized by dispersing them as finely divided particles in a suitable molten salt. In general, the finely divided materials may be of a mesh size of 50 or less.

MAGNESIUM METAL PRECURSOR

The magnesium metal precursor will be selected from materials which undergo reduction at the conditions found in the above cell to yield magnesium metal. Suitable magnesium metal precursors include magnesium halides, for example, magnesium chloride, magnesium iodide, magnesium bromide, etc., magnesium nitrates and nitrites; magnesium sulfate, magnesium organic acid salts such as magnesium formate, magnesium carbonate, magnesium propionate; magnesium hydroxide and magnesium oxide. Preferably, the magnesium metal precursor is magnesium oxide or materials which are converted to the oxide at the conditions of electrolytic reduction found in the cell. Examples of such materials include the above organic acid salts. Magnesium oxide is the most preferred material because of its ready availability in a highly pure, anhydrous form.

Molten Salts

A molten salt is used when the magnesium metal precursor is not liquid at the conditions of economical operation of the above cell. A molten salt may also be used with magnesium metal precursors which are liquid at such conditions. In general, the molten salt functions as a flux to liquify the higher melting magnesium metal precursors such as magnesium oxide. It must have suitable conductivity to carry out the reduction disclosed above and must be of a lower density than the molten silicon alloy. The molten salt must be a liquid at the temperature of electrical reduction found in the cell. Finally, the salt must be free from contaminants that are soluble in the molten silicon alloy although contaminants which are not vaporized with magnesium may be tolerated since they will remain with the molten silicon alloy. The cation constituents of the molten salt must be less noble than magnesium to avoid their reduction and deposition in the molten silicon alloy in preference to the magnesium. Molten salts are generally bi-component mixtures having the above characteristics. For example, the alkali and alkaline earth metal halides and mixtures thereof may be utilized as the molten salt. Especially preferred are the fluorides of the aforegoing alkaline, alkaline earth and rare earth metals, such as $MgF_2$, NaF, LaF, $Cef_3$, LiF, $Baf_2$, $SrF_2$ and $CaF_2$.

Molten Silicon Alloy

The molten silicon alloy is also selected to be a liquid at the conditions at which the above cell is operated. Moreover, the molten silicon must have the proper conductivity characteristics to effect the reduction of the magnesium metal precursor to the metal. The molten silicon alloy may contain from about 5 to 90 weight percent silicon; preferable from 30 to 90 weight percent silicon. At silicon contents below 5 % by weight, insufficient magnesium will be soluble in the alloy while at silicon contents greater than 90% by weight, the density of the alloy will be insufficient to remain below the molten salt-magnesium precursor mixture. It is noted that lower amounts of silicon can be tolerated than in the process described in U.S. Pat. No. 3,503,857 since the magnesium is continuously removed in the instant invention. The molten silicon alloy is selected so that the vapor pressure of the components thereof at the temperature in the cell will be insufficient to carry over the magnesium metal vapor. For example, the presence of alkali metals or mercury in the molten silicon alloy should be avoided since these materials tend to have very high vapor pressures at the conditions found in the cell. Suitable molten silicon alloys include ferrosilicon, coppersilicon, tin silicon and nickel silicon alloys. The alloy metal must be more noble than magnesium so that the magnesium metal precursor is reduced at the interface of the silicon alloy. Furthermore, the alloy metals are selected so as not to interact strongly with magnesium metal whereby the stripping of the metal with the inert gas is hindered. The alloys given below are suitable since each meets the above criteria:

90% copper and 10% silicon; 50% iron and 50% silicon, by weight.

The following is a preferred embodiment of the instant invention.

Using a cell generally similar to the one shown in the figure, molten coppersilicon containing about 10% by weight silicon is introduced into the cell which contains a molten mixture of 70–85 weight percent magnesium fluoride and 15–30 weight percent barium fluoride. The copper silicon being more dense than the above salt mixture settles at the bottom of the cell where it contacts the negatively charged graphite element.

The molten salt mixture floats on top of and covers the molten coppersilicon. The molten salt is contacted by vertically positioned graphite electrodes as shown. The electric potential across the cell is adjusted to provide a cathode current density of 0.7 to 1.5 amps per square inch. The temperature of the cell is maintained at about 900° to 1250° C. to ensure that all of the constituents are in a molten state. The cathode area is 70,000 to 150,000 $CM^2$ and the total cell current is on the order of 70,000 to 200,000 amperes. Magnesium oxide having a mesh size of 50 or less is added to the cell at a rate of from about 170 to 340 lbs. per hour. Magnesium metal is liberated at the interface of the molten salt and the molten silicon alloy and dissolves in such alloy at a rate of about 100 to 200 lbs. per hour. An inert gas, for example, argon is passed through compartment 3 at a rate of about 1 lb. of argon per 1 lb. of magnesium. The temperature in compartment 3 is roughly equivalent to the temperature in the electrical reduction portion of the cell. 100 to 200 pounds per hour of magnesium metal is removed as vapor and condensed in magnesium removal zone which is maintained at a temperature of 900° C. or less.

Oxygen is liberated during the electrical reduction of the magnesium oxide at the graphite anodes and forms carbon monoxide which is removed from the cell through an exit port not shown in the figure. The instant process is continuous and may be operated for as long as required.

What is claimed is:

1. A method for producing magnesium metal which comprises the steps of:

(a) providing a molten magnesium metal precursor, (b) providing molten silicon alloy beneath the molten magnesium metal precursor in contact therewith, the density of the molten magnesium metal precursor being less than that of the molten alloy, (c) applying an electric potential to the molten silicon alloy whereby it is cathodically energized, (d) contacting the molten magnesium metal precursor with an anodically energized electrode, (e) causing an electric current to flow between the anodically energized electrode and the cathodically energized molten silicon alloy sufficient to reduce said magnesium metal precursor whereby magnesium metal is liberated and deposited on the molten silicon alloy and dissolved therein, and (f) vaporizing said dissolved magnesium metal by passing an inert gas through said molten silicon alloy containing magnesium metal dissolved therein at a temperature and rate whereby a substantially pure magnesium metal vapor is removed from said molten silicon alloy.

2. The method of claim 1 wherein said magnesium metal precursor is selected from the group consisting of magnesium halides, magnesium nitrate, magnesium nitrite, magnesium sulfate, magnesium sulfite, magnesium oxide, magnesium hydroxide, magnesium carbonate, and the magnesium salts of the lower organic acids.

3. The method of claim 2 wherein said magnesium metal precursor is magnesium oxide.

4. The method of claim 3 wherein said magnesium oxide is suspended in a molten salt bath.

5. The method of claim 4 wherein said molten salt bath is a mixture of two or more salts selected from the group consisting of fluorides of the alkaline, alkaline earth and rare earth metals.

6. The method of claim 5 wherein said molten salt bath is a mixture of two or more salts selected from the group consisting of $MgF_2$, NaF, $LaF_3$, $CeF_3$, LiF, $BaF_2$, $SrF_2$ and $CaF_2$.

7. The method of claim 6 wherein said molten silicon alloy comprises from about 30 to 90% by weight silicon.

8. The method of claim 7 wherein said molten silicon alloy is selected from the group consisting of ferro silicon, copper silicon, tin silicon and nickel silicon.

9. The method of claim 8 wherein said inert gas is selected from the group consisting of nitrogen and argon.

10. The method of claim 9 wherein the amount of magnesium metal in said molten silicon alloy is held to an amount less than about 5% by weight.

11. A method for producing magnesium metal which comprises the steps of:

(a) providing a molten salt bath suitable for use as an electrolyte in the electrolysis of a magnesium metal precursor, (b) providing molten ferro silicon beneath the molten salt bath and in contact therewith, the density of the molten salt bath being less than that of the molten ferro silicon, (c) applying an electric potential to the molten ferro silicon whereby it is cathodically energized, (d) contacting the molten salt bath with an anodically energized electrode, (e) suspending the magnesium metal precursor in the molten salt bath, (f) causing an electric current to flow between the anodically energized electrode and the cathodically energized molten ferro silicon sufficient to reduce said magnesium metal precursor whereby magnesium metal is liberated and deposited on the molten ferro silicon and dissolved therein, (g) continuously passing a portion of said molten ferro silicon containing magnesium metal dissolved therein into a magnesium metal removal zone, (h) vaporizing said dissolved magnesium metal by passing an inert gas through said portion of step (g) at a temperature and rate whereby a substantially pure magnesium metal vapor is removed overhead and a molten ferro silicon fraction depleted in magnesium remains behind, and (i) returning said ferro silicon fraction depleted in magnesium to said molten ferro silicon of step (b).

12. The method of claim 11 wherein said magnesium metal precursor is selected from the group consisting of magnesium halides, magnesium nitrate, magnesium nitrite, magnesium sulfate, magnesium sulfite, magnesium oxide, magnesium hydroxide, magnesium carbonate, and the magnesium salts of the lower organic acids.

13. The method of claim 12 wherein said magnesium metal precursor is magnesium oxide.

14. The method of claim 13 wherein said molten salt bath is a mixture of two or more salts selected from the group consisting of fluorides of the alkaline, alkaline earth and rare earth metals.

15. The method of claim 14 wherein said molten salt bath is a mixture of two or more salts selected from the group consisting of $MgF_2$, NaF, $LaF_3$, $CeF_3$, LiF, $BaF_2$, $SrF_2$, and $CaF_2$.

16. The method of claim 15 wherein said molten silicon alloy comprises from about 30 to 90% by weight silicon.

17. The method of claim 16 wherein said inert gas is selected from the group consisting of nitrogen and argon.

18. The method of claim 17 wherein the amount of magnesium metal in said molten silicon alloy is held to an amount less than about 5% by weight.

* * * * *

UNITED STATES PATENT AND TRADEMARK OFFICE

CERTIFICATE OF CORRECTION

PATENT NO. : 4,298,437

DATED : November 3, 1981

INVENTOR(S) : Robert A. Hard

It is certified that error appears in the above–identified patent and that said Letters Patent are hereby corrected as shown below:

Column 1, line 66, change "salt" to --metal--.

Colunn 6, line 3, change "$Cef_3$" to --$CeF_3$--.

line 3, change "$Baf_2$" to --$BaF_2$--.

Signed and Sealed this

*Nineteenth* Day of *January 1982*

[SEAL]

*Attest:*

GERALD J. MOSSINGHOFF

*Attesting Officer*

*Commissioner of Patents and Trademarks*